US005277487A

United States Patent [19]

Simon

[11] Patent Number: 5,277,487

[45] Date of Patent: Jan. 11, 1994

[54] TOE KICK DRAWER AND METHOD OF MANUFACTURING A CABINET WITH A TOE KICK DRAWER

[75] Inventor: Ron Simon, Torrance, Calif.

[73] Assignee: RSI Home Products, La Mirada, Calif.

[21] Appl. No.: 973,288

[22] Filed: Nov. 9, 1992

Related U.S. Application Data

[63] Continuation-in-part of Ser. No. 827,955, Jan. 28, 1992.

[51] Int. Cl.[5] ..... A47K 1/05; A47B 88/04; A47B 88/14

[52] U.S. Cl. ..... 312/278; 312/228; 312/330.1; 312/334.7; 29/434

[58] Field of Search ..... 312/330.1, 334.7, 228, 312/279, 278; D6/510, 524; 29/428, 434

[56] References Cited

U.S. PATENT DOCUMENTS

| | | | |
|---|---|---|---|
| D. 250,595 | 12/1978 | Tebbe et al. . | |
| D. 262,342 | 12/1981 | Keller . | |
| 354,917 | 12/1886 | Lowrie | 312/228 |
| 2,320,556 | 6/1943 | Belshaw | 312/228 |
| 2,498,402 | 2/1950 | Earle | 312/330.1 |
| 2,775,500 | 12/1956 | Etherington . | |
| 4,098,545 | 7/1978 | Gaiser et al. . | |
| 4,337,988 | 7/1982 | Schenck . | |
| 4,429,931 | 2/1984 | Brooks . | |

FOREIGN PATENT DOCUMENTS

| | | | |
|---|---|---|---|
| 31150 | 10/1933 | Netherlands | 312/228 |
| 579071 | 8/1941 | United Kingdom | 312/278 |

*Primary Examiner*—P. W. Echols
*Assistant Examiner*—David P. Bryant
*Attorney, Agent, or Firm*—Spensley Horn Jubas & Lubitz

[57] ABSTRACT

A toe kick drawer is supported in an inset base beneath an enclosure of a bathroom vanity cabinet. The toe drawer has a recess which conforms to the inset base of the cabinet and preserves the ability of a user to place a front part of a foot underneath the cabinet when using a sink. The toe drawer allows efficient use of space and protects items and articles from water damage. The toe drawer may have rolling or sliding means coupled to the cabinet for easy opening or closing by a hand or a loot.

37 Claims, 4 Drawing Sheets

TOE KICK DRAWER AND METHOD OF MANUFACTURING A CABINET WITH A TOE KICK DRAWER

This is a Continuation-In-Part of U.S. patent application No. 07/827,955 filed Jan. 28, 1992.

FIELD OF THE INVENTION

This invention relates to a toe kick drawer for use in bathroom vanity cabinets.

BACKGROUND OF THE INVENTION

Bathroom vanity cabinets are a common feature of modern bathrooms. Often, these cabinets have to deal with the problems associated with plumbing contained inside the cabinet. The purpose of the bathroom vanity cabinet is to hold a bathroom sink and cover the associated plumbing, while providing an enclosure for holding various items and articles.

A typical bathroom vanity cabinet 210 is shown in FIGS. 9 and 10. This cabinet 210 is comprised of a base 224, a pair of side walls 218, a back wall 232, a sink wall 220, a cabinet door 222, and a counter 212. The pair of side walls 218 are joined to the back wall 232 to form the sides and back of the vanity cabinet 210. The side walls 218 have inset notches cut into the lower front corners which connect to a base board 238. Base 224 is formed when the cabinet floor 234 is joined to the base board 238, the side walls 218 and the back wall 232. The base 224 of the cabinet 210 is inset to allow the user's feet to fit under the cabinet 210 when the user uses the sink 216.

Above the notch in one of the side walls 218, the cabinet door 222 is attached by hinges. When the door 222 is closed, it latches to the other side wall 218. The door 222 has a handle 221 attached to aid the user in opening and closing the door 222. Above the door 222, is the sink wall 220, which is joined to the pair of side walls 218 and completes the walls of the cabinet 210. Attached to the tops of the walls of the cabinet 210 is the counter 212. The counter 212 is attached by screws or adhesive and has a recess for holding a sink 216. The counter 212 is designed to hold bathroom articles or items when they are in use. At the back of the counter 212 is a "back-splash" 214 which protects the surrounding walls of the bathroom against splashes from the sink 216.

Referring to the cut-away view of FIG. 10, the enclosure 236 is formed by the cabinet floor 234, the pair of side walls 218, the back wall 232, the counter 212, and the sink wall 220. Access to the enclosure 236 is through the door 222. The enclosure 236 covers from view the plumbing associated with the sink 216. A sink bottom 225 is covered from view by the sink wall 220. Attached to the sink bottom 225 is a connector 226 connected to a pipe 228. The pipe 228 connects to an "S" joint 230, which connects to another pipe 231, which in turn connects to a drain in the bathroom.

The cut-away of FIG. 10 shows that a large amount of space is taken up by the plumbing in the enclosure 236. Only small articles can be placed under and to the sides of the "S" joint 230. Due to the obstruction of space and the general unaesthetic appearance of the plumbing housed in the enclosure 236, it is often the case that the enclosure 236 is not used for storage. This results in a considerable waste of storage space.

Further, due to the moist environment and the possibility of leaks from the plumbing, articles and items susceptible to water damage are not placed in the enclosure 236. This limits the utility of the cabinet 210, because needed supplies or articles have to be stored in less convenient areas.

SUMMARY OF THE DISCLOSURE

It is an object of the present invention to provide a toe drawer, and, in particular embodiments, a vanity cabinet with a toe drawer which obviates for practical purposes, the above mentioned limitations for traditional cabinets.

According to an embodiment of the present invention, a toe drawer for use with a cabinet having an inset base and an enclosure with a floor, includes a drawer which is supported in the base of the cabinet beneath the floor of the cabinet enclosure. The drawer has a front panel portion with a recessed lower front panel portion with respect to the front panel portion of the drawer. The recessed portion conforms to the inset base and area beneath the floor of the enclosure. The drawer is designed such that the toes and front part of a user's feet may fit inside the recess formed by the front panel portion and the lower front panel portion.

In the illustrative embodiment, the toe drawer has at least two compartments. One of the compartments may be formed above the recess formed by the front panel portion and the lower front panel portion. This allows the toe drawer to accommodate and hold small articles and items in a small compartment separated from a larger main compartment.

The toe drawer according to the illustrated embodiment may be coupled to the cabinet by sliding or rolling means for sliding the drawer in and out. The drawer may also have the front panel portion of the drawer overhang the recessed lower front panel portion. This aids a user in using the front part of the foot to engage the drawer, such that it can be opened and closed.

Other features and advantages of the invention will become apparent from the following detailed description, taken in conjunction with the accompanying drawings, which illustrate, by way of example, the features of embodiments of the present invention.

BRIEF DESCRIPTION OF THE DRAWINGS

The detailed description of embodiments of the invention will be made with reference to the accompanying drawings, wherein like numerals designate corresponding parts in the several figures.

DETAILED DESCRIPTION OF THE DISCLOSURE

Figure 1:
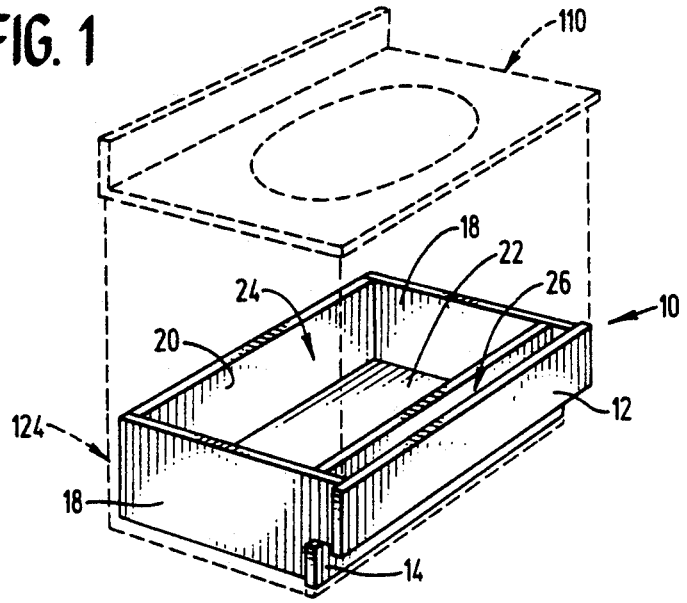
FIG. 1 shows a perspective view of an embodiment of the present invention.
Figure 2:
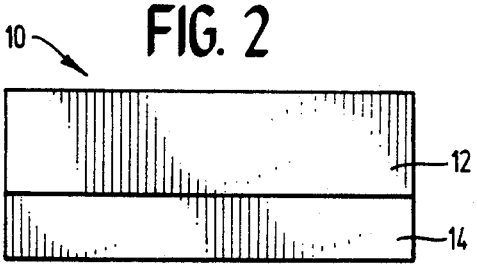
FIG. 2 shows a front view of the embodiment shown in FIG. 1.

The following detailed description is of the best presently contemplated mode of carrying out the invention. This description is not to be taken in a limiting sense, but is made merely for the purpose of illustrating general principles of embodiments of the invention. The scope of the invention is best defined by the appended claims.

As shown in the drawings for purposes of the illustration, the invention is embodied in a toe drawer 10 for use with a cabinet 110 having an inset base and an enclosure with a floor. The drawer is supported in and conforms to the inset base and the area beneath the floor of the enclosure of cabinet 110. The toe drawer allows a more efficient use of the space beneath the plumbing and provides protection for articles and items from water damage.

Figure 7:
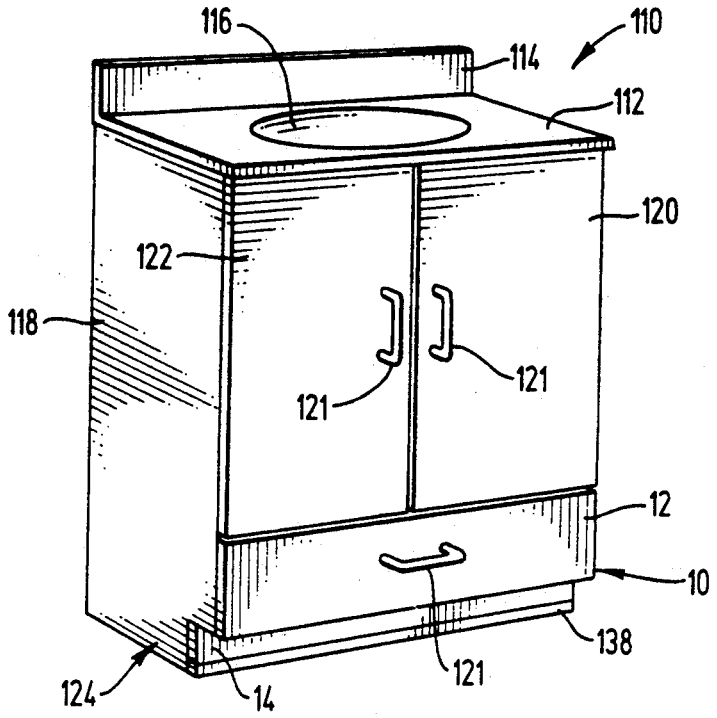
FIG. 7 shows a front perspective view of a vanity according to a embodiment of the present invention.

A bathroom vanity cabinet 110 according to an embodiment of the present invention, having a toe drawer 10, is illustrated in FIGS. 7 and S. This cabinet 110 is comprised of a base 124, a pair of side walls 118, a back wall 132, a pair of cabinet doors 120 and 122, and a counter 112. The pair of side walls 119 are coupled to the back wall 132 to form the sides and back of the vanity cabinet 110. The side walls 118 have inset notches in the lower front corners of the side walls 118. The lower edges of the notches are coupled to a base board 138.

Figure 8:
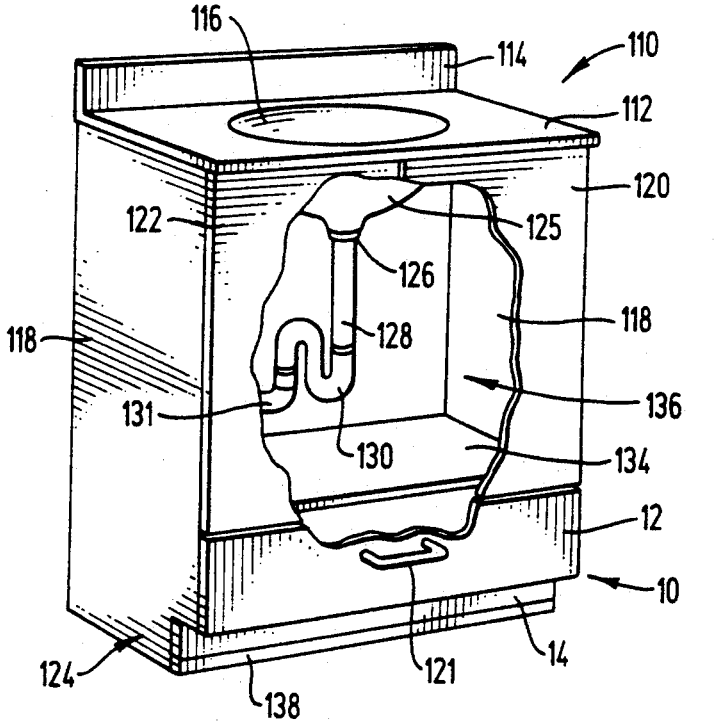
FIG. 8 shows a cut-away view of the embodiment shown in FIG. 7.

A cabinet floor 134 is coupled to the side walls 118 and the back wall 132, this along with the base board 138 forms the base 124 of the cabinet 110. FIG. 8 shows that the floor 134 is above and spaced from the top edge of the notches in the side walls 118. The base 124 of the cabinet 110 has an inset portion to allow the user's feet to fit beneath the cabinet 110 when the user uses the sink 116.

Above the notches on the side walls 118, is the pair of cabinet doors 120 and 122 which are attached by hinges or the like. The lower edges of the doors 120 and 122 end at the level of the cabinet floor 134. When the doors 120 and 122 are closed, the doors latch to the cabinet floor 134 and/or the bottom of the counter 112. The doors 120 and 122 each have a handle 121 attached to aid the user in opening and closing the doors. Attached to the tops of walls of the cabinet 110 is the counter 112. The counter 112 is attached by screws, adhesives, or the like, and the counter 112 has a recess for holding a sink 116. At the back of the counter 112 is a "back-splash" 114 which protects the surrounding walls of the bathroom against splashes from the sink 116.

The toe drawer 10 is supported in the base 124, just below the floor 134 and the doors 120 and 122. When the toe drawer 10 is closed, a front part of a foot can fit inside the inset portion of the base 124, since the toe drawer lo conforms to the shape of the base 124.

Referring to the cut-away view of FIG. 8, the enclosure 136 is formed by the floor 134, the pair of side walls 118, the back wall 132, and the counter 112. Access to the enclosure 136 is through the doors 120 and 122. The enclosure 136 covers the plumbing associated with the sink 116. Attached to a sink bottom 125 is a connector 126 connected to a pipe 128. The pipe 128 connects to an "S" joint 130, which connects to another pipe 128, which in turn connects to a drain.

Figure 9:
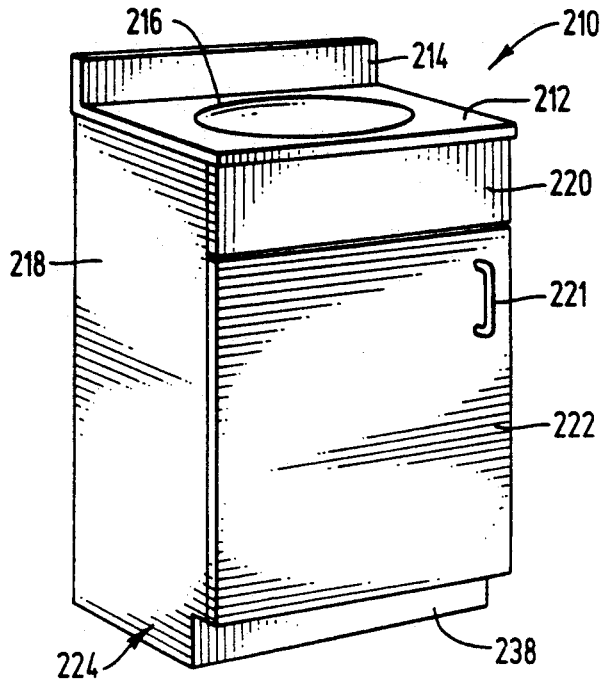
FIG. 9 PRIOR ART
FIG. 9 shows a front perspective view of a traditional prior art bathroom vanity.
Figure 10:
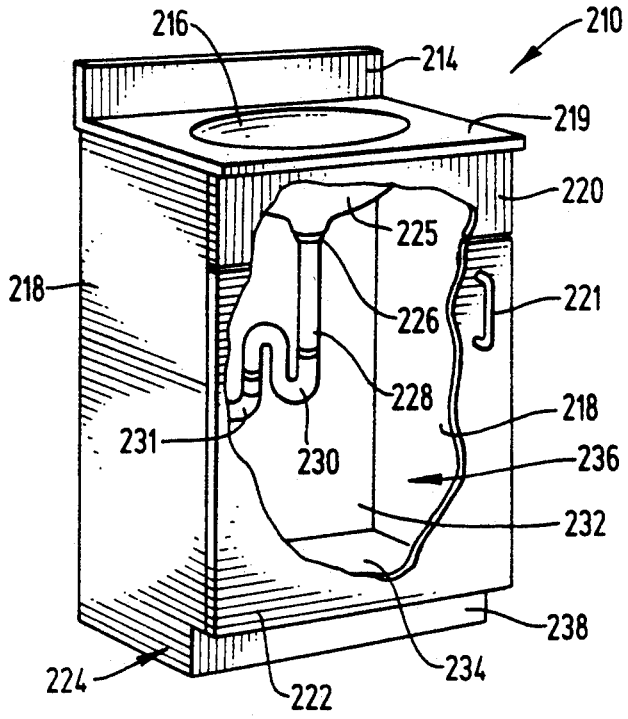
FIG. 10 PRIOR ART
FIG. 10 shows a cut-away view of the traditional prior art bathroom vanity shown in 9.

The floor 134 is coupled such that it is higher up in the cabinet 110 than the floor 234 in the traditional cabinet 210 shown in FIG. 10. This creates a larger base 124 and allows a more effective use of space in the cabinet 110. It also provides a larger space for the toe drawer 10. Articles may be placed on the sides of the plumbing as in the traditional cabinet 210 in FIGS. 9 and 10. However, the toe drawer 10 provides additional usable storage space beyond that available in the traditional cabinet 210. Further, the floor 134 helps protect the contents of the toe drawer 10 from moisture or possible leaks, thereby, allowing users to conveniently store articles or items in the toe drawer 10 which can be damaged by water. However, it will be recognized that in further embodiments of the vanity, the floor 134 may be eliminated so as to leave an opening between the interiors of the enclosure 136 and the toe drawer 10.

Figure 3:
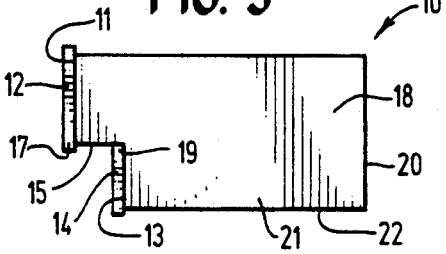
FIG. 3 shows a side view of the embodiment shown in FIG. 1.
Figure 5:
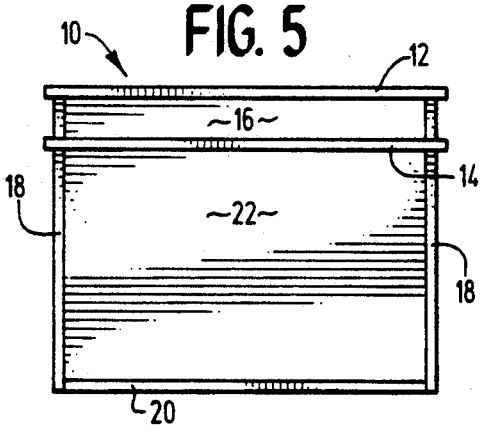
FIG. 5 shows a bottom view of the embodiment shown in FIG. 1.
Figure 6:
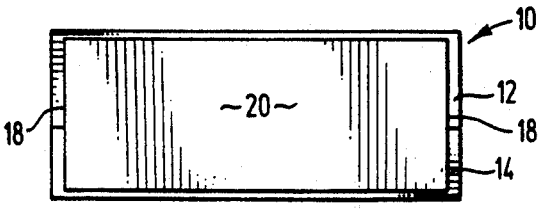
FIG. 6 shows a back view of the embodiment shown in FIG. 1.

The toe drawer 10, according to an embodiment of the present invention, will now be described with reference to FIGS. 1–6. The toe drawer 10 is a drawer which is inserted into the inset base 124 of the cabinet 110 beneath the floor 134 of the enclosure 136. The toe drawer 10 has a back 20 coupled by nails, screws, adhesives, or the like, to two sides 18 and a first bottom 22, as shown in FIGS. 5 and 6. The two sides 18 each have a first bottom edge 21 and are coupled by nails, screws, adhesives or the like, to the first bottom 22, as shown in FIGS. 3 and 5. Further, the two sides 18 each have a first leading edge 11 and notches formed below the first leading edge 11. The notches form a recessed second bottom edge 15 and a recessed second leading edge 13.

As shown in FIGS. 1–5, a first front panel 12 has a bottom edge 17 and is coupled by nails, screws, adhesives, or the like to each of the first leading edges 11 of the two sides 18. A second front panel 14 has a top edge 19 and is coupled by nails, screws, adhesive, or the like, to the first bottom 22 and each of the second leading edges 13 of the two sides 18. A second bottom 16 is coupled by nails, screws, adhesives, or the like, to the bottom edge 17 of the first front panel 12, the top edge 19 of the second front panel 14, and each of the second bottom edges 15 of the two sides 18. This provides a recess where a front part of a foot may fit beneath the second bottom 16.

As shown in the perspective view of FIG. 1, the toe drawer 10 fits inside the cabinet 110. The toe drawer is contained in the base 124 and is beneath the cabinet floor 134 as shown in FIGS. 7 and 8. As shown by FIGS. 1, 7, and 8, the toe drawer 10 conforms to the shape and lines of the cabinet 110, thus preserving the feature of allowing a user to recess the front of the foot underneath the cabinet 110.

Figure 4:
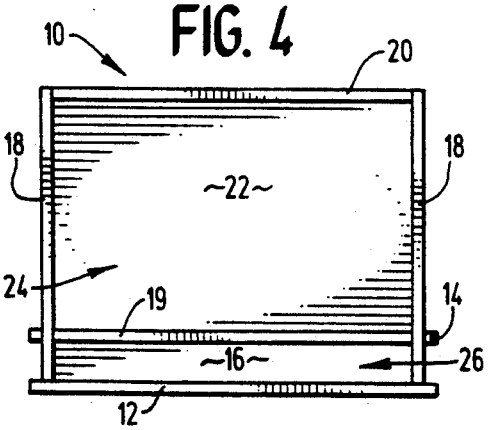
FIG. 4 shows a side view of the embodiment shown in FIG. 1.

The illustrated embodiment as shown in FIGS. 1 and 4, the toe drawer 10 has two compartments 24 and 26. The co? Apartment 26 of the toe drawer 10 is formed by the top edge 19 of the lower front panel 14 extending up to the top edge of the toe drawer 10. Compartment 26 is above the second bottom 16 at the front of the drawer. Compartment 26 may be used to hold articles that need to be readily accessible, thus limiting the extent to which the toe drawer 10 must be opened to reach these articles. The other compartment 24 may be used to hold larger items or articles. Both compartments 24 and 26 of the toe drawer are safe for items or articles susceptible to water damage, since the cabinet floor 134 tends to keep moisture and water leaks from the plumbing away from articles held by the toe drawer 10.

The toe drawer 10 in the illustrated embodiment of FIG. 1 is shown inset into the cabinet 110 without any connecting means. However, toe drawer 10 may be coupled and mounted to the cabinet by a roller or sliding means (not shown). The toe drawer 10 may use sliding means such as rails, guides, grooves, slots, wheels or the like, of the type well known for mounting drawers in cabinet structures for sliding the drawer in and out.

To aid the sliding means or to make the toe drawer easier to open, the bottom edge 17 of the first front panel 12 extends down below the second bottom 16 as shown in FIG. 3. This allows the user to easily grip and engage the toe drawer 10 by the front part of the foot (or by a hand) to open or close the toe drawer 10. However, this does not exclude the attachment of a handle 121 as shown in FIGS. 7 and 8.

Figure 11:
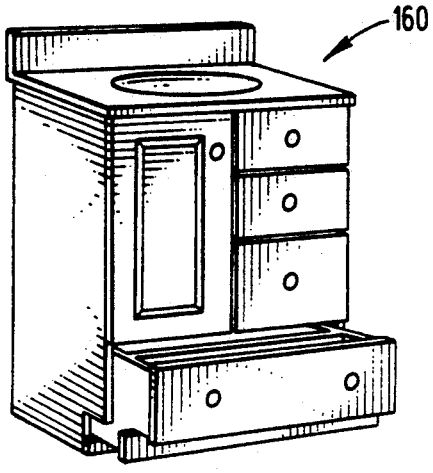
FIG. 11 shows another vanity according to an embodiment of the present invention.
Figure 12:
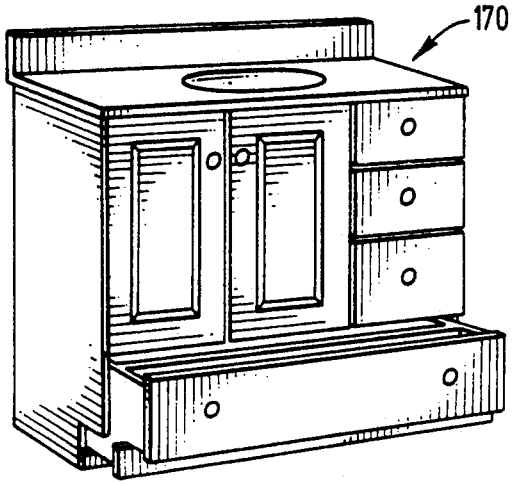
FIG. 12 shows another vanity according to an embodiment of the present invention.
Figure 13:
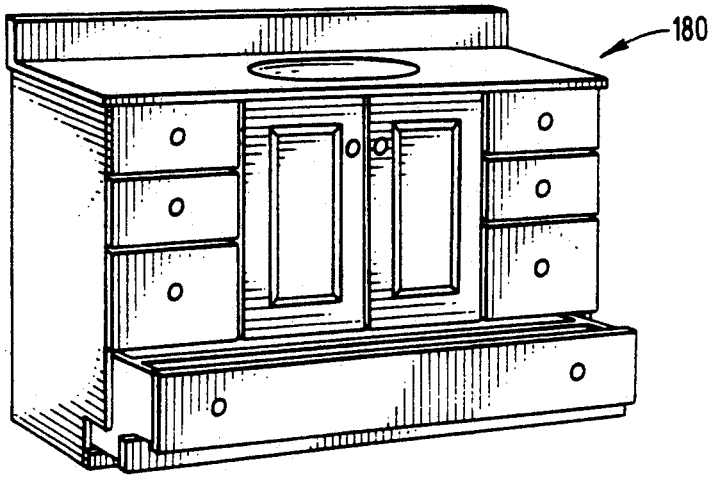
FIG. 13 shows another vanity according to an embodiment of the present invention.

FIGS. 11-13 show other embodiments of a toe drawer in bathroom vanities 160, 170, and 180 having additional side drawers mounted on the sides. These side drawers are in addition to the cabinets underneath the sink. It should be noted that in each of these embodiments the toe drawer conforms to the inset shape of the base of the cabinet to allow the front part of the foot to fit into the recess. Further, these drawers incorporate the space saving features and the water protection as described above. Moreover, it will be recognized that the preferred embodiment is the vanity with a toe drawer. However, in further embodiments of the present invention, the toe drawer may be used on other furniture having an inset base.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A cabinet, comprising:

a cabinet housing having an inset base beneath an enclosure;

a toe drawer supported in the base of the cabinet housing beneath the cabinet housing enclosure; wherein the toe drawer has at least one interior compartment, a front portion, and a lower front port recessed with respect to the front portion to define a recess that conforms to the inset base beneath the enclosure, and wherein a portion of the at least one compartment defines an overhang which extends over the recess defined between the lower recessed front portion and the front portion.

2. A cabinet according to claim 1, wherein the cabinet housing has dimensions suitable for housing plumbing inside the enclosure.

3. A cabinet according to claim 1, wherein the toe drawer has at least two interior compartments.

4. A cabinet according to claim 3, wherein one of the at least two interior compartments is above the recess defined between the recessed lower front portion and the front portion.

5. A cabinet according to claim 1, wherein sliding means for sliding the toe drawer relative to the cabinet housing inset base is coupled to the toe drawer and the cabinet housing.

6. A cabinet according to claim 1, wherein rolling means for rolling the toe drawer relative to the cabinet housing inset base is coupled to the toe drawer and the cabinet housing.

7. A cabinet according to claim 1, wherein the front portion of the toe drawer overhangs the recessed lower front portion, such that the overhanging front portion of the toe drawer defines an underside which can be engaged by the front part of a person's foot.

8. A cabinet according to claim 1, wherein the at least one interior compartment is shaped to conform to an external surface formed by the front portion, the recessed lower front portion and the recess defined between the front portion and the recessed lower front portion.

9. A method of manufacturing a cabinet, comprising the steps of:

forming a cabinet housing defining an enclosure and having an inset base beneath the enclosure;

forming a toe drawer having at least one interior compartment and a front portion;

forming a recessed lower front portion in the toe drawer with respect to the front portion of the toe drawer to define a recess that conforms to the inset base beneath the enclosure;

forming a portion of the at least one interior compartment to define an overhang which extends over the recess defined between the recessed lower front portion and the front portion; and installing the toe drawer in the inset base beneath the enclosure.

10. A method according to claim 9, further comprising the step of providing plumbing inside the enclosure of the cabinet housing.

11. A method according to claim 9, further comprising the step of providing the toe drawer with at least two interior compartments.

12. A method according to claim 11, wherein one of the at least two interior compartments is provided above the recess defined between the recessed lower front portion and the front portion.

13. A method according to claim 9, further comprising the steps of providing sliding means for sliding the toe drawer in and out, and coupling the sliding means to the toe drawer and the cabinet housing.

14. A method according to claim 9, further comprising the steps of providing rolling means for rolling the toe drawer in and out, and coupling the rolling means to the toe drawer and the cabinet housing.

15. A method according to claim 9, wherein the front portion of the toe drawer overhangs the recessed lower front portion, such that the overhanging front portion of the toe drawer defines an underside which can be engaged by a front portion of a person's foot.

16. A method according to claim 9, further comprising the step of shaping the at least one interior compartment to conform to an external surface formed by the front portion, the recessed lower front portion and the recess defined between the front portion and the recessed lower front portion.

17. A toe drawer for a cabinet having an inset base and an enclosure, the toe drawer being supported in the inset base of the cabinet beneath the enclosure, the toe drawer comprising:

at least one compartment a front panel portion; and a second lower front panel portion recessed with respect to the front panel portion to define a recess that conforms to the insert base beneath the enclosure, and wherein a portion of the at least one compartment defines an overhang which extends over the recess defined between the recessed second lower front panel portion and the front panel portion.

18. A toe drawer according to claim 17, wherein the drawer has at least two compartments.

19. A toe drawer according to claim 18, wherein one of the at least two compartments is above the recess defined between the recessed second lower front panel portion and the front panel portion.

20. A toe drawer according to claim 17, wherein sliding means for sliding the drawer relative to the cabinet inset base is coupled to the drawer and the cabinet.

21. A toe drawer according to claim 17, wherein rolling means for rolling the drawer relative to the cabinet inset base is coupled to the drawer and the cabinet.

22. A toe drawer according to claim 17, wherein the front panel portion of the drawer overhangs the recessed second lower panel portion, such that the overhanging front portion of the toe drawer defines an underside which can be engaged by the front part of a person's foot.

23. A toe drawer according to claim 17, wherein the at least one compartment is shaped to confrom to an external surface formed by the front portion, the recessed second lower front portion and the recess defined between the front portion and the recessed second lower front portion.

24. A toe drawer for a cabinet having an inset base and an enclosure, the toe drawer being supported in the inset base of the cabinet beneath the enclosure, the toe drawer comprising:

two side panels and a first bottom;

the two side panels each having a first bottom edge coupled to the first bottom;

a back coupled to the two side panels and the first bottom;

the two side panels each further having a first leading edge and a notch formed below the first leading edge, the notch forming a recessed second bottom edge and a recessed second leading edge;

a first front panel having a bottom edge, the first front panel being coupled to each of the first leading edges of the two sides;

a second front panel having a top edge, the second front panel being coupled to the first bottom and each of the second leading edges of the two sides; and a second bottom coupled to the bottom edge of the first front panel, the top edge of the second front panel, and each of the second bottom edges of the two sides, wherein the two side panels, the back, the first and second bottoms, and the first and second front panels form at least one compartment, and wherein a portion of the at least one compartment overhangs the second bottom.

25. A toe drawer according to claim 24, wherein the drawer has at least two compartments.

26. A toe drawer according to claim 25, wherein the drawer has a top edge, wherein the two side panels and the first front panel define walls that extend to the top edge of the drawer, and wherein one of the at least two compartments is formed above the second bottom between the walls defined by first front panel, the two side panels and by another wall defined by the top edge of the second front panel extending to the top edge of the drawer.

27. A toe drawer according to claim 24, wherein sliding means for sliding the drawer is coupled to the drawer and the cabinet.

28. A toe drawer according to claim 24, wherein rolling means for rolling the drawer is coupled to the drawer and the cabinet.

29. A toe drawer according to claim 24, wherein the first front panel bottom edge extends below the second bottom of the drawer, such that the overhanging front portion of the toe drawer defines an underside which can be engaged by the front part of a foot.

30. A toe drawer according to claim 42, wherein at least one handle is attached to the first front panel of the drawer.

31. A cabinet, comprising:

a cabinet housing having an inset base beneath an enclosure;

a toe drawer supported in the base of the cabinet housing beneath the cabinet housing enclosure; wherein the toe drawer has at least one compartment with a bottom, a front wall, and a lower front wall, recessed with respect to the front wall to confrom to the inset base beneath the enclosure, and wherein the lower front recessed wall extends above the bottom of the at least one compartment.

32. A cabinet according to claim 31, wherein the cabinet housing has dimensions suitable for housing plumbing inside the enclosure.

33. A cabinet according to claim 31, wherein the toe drawer has at least two compartments.

34. A cabinet according to claim 33, wherein one of the at least two compartments is above the recessed lower front wall.

35. A cabinet according to claim 31, wherein sliding means for sliding the toe drawer relative to the cabinet housing inset base is coupled to the toe drawer and the cabinet housing.

36. A cabinet according to claim 31, wherein rolling means for rolling the toe drawer relative to the cabinet housing inset base is coupled to the toe drawer and the cabinet housing.

37. A cabinet according to claim 31, wherein the front wall of the toe drawer overhangs the recessed lower front wall, such that the overhanging front wall of the toe drawer defines an underside which can be engaged by the front part of a person's foot.

* * * * *